US007159660B2

(12) United States Patent
Justus

(10) Patent No.: US 7,159,660 B2
(45) Date of Patent: Jan. 9, 2007

(54) HYDRAJET PERFORATION AND FRACTURING TOOL

(75) Inventor: Donald M. Justus, Houston, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 62 days.

(21) Appl. No.: 10/856,903

(22) Filed: May 28, 2004

(65) Prior Publication Data

US 2005/0263284 A1 Dec. 1, 2005

(51) Int. Cl.
*E21B 43/26* (2006.01)

(52) U.S. Cl. ..... 166/308.1; 166/177.5; 166/222

(58) Field of Classification Search ..... 166/297, 166/308.1, 55.1, 177.5, 222; 175/67, 424
See application file for complete search history.

(56) References Cited

U.S. PATENT DOCUMENTS

| | | | | |
|---|---|---|---|---|
| 2,011,518 | A * | 8/1935 | Griffin | 175/314 |
| 2,847,073 | A * | 8/1958 | Arterbury et al. | 166/147 |
| 3,130,783 | A * | 4/1964 | Orr | 166/284 |
| 3,145,776 | A * | 8/1964 | Pittman | 166/55 |
| 4,050,529 | A * | 9/1977 | Tagirov et al. | 175/424 |
| 4,625,799 | A * | 12/1986 | McCormick et al. | 166/223 |
| 4,798,244 | A * | 1/1989 | Trost | 166/250.01 |
| 4,808,925 | A | 2/1989 | Baird | 324/221 |
| 4,951,751 | A | 8/1990 | Jennings | 166/285 |
| 5,117,912 | A | 6/1992 | Young | 166/305.1 |
| 5,363,919 | A | 11/1994 | Jennings | 166/308 |
| 5,381,864 | A | 1/1995 | Nguyen et al. | 166/280 |
| 5,406,078 | A | 4/1995 | Jacobson | 250/261 |
| 5,499,678 | A * | 3/1996 | Surjaatmadja et al. | 166/298 |
| 5,743,334 | A | 4/1998 | Nelson | 166/250.07 |
| 5,765,642 | A * | 6/1998 | Surjaatmadja | 166/297 |
| 5,899,958 | A | 5/1999 | Dowell et al. | 702/6 |
| 5,941,308 | A | 8/1999 | Malone | 166/313 |
| 5,967,244 | A * | 10/1999 | Arfele | 175/340 |
| 6,006,838 | A * | 12/1999 | Whiteley et al. | 166/306 |
| 6,012,525 | A | 1/2000 | Burleson et al. | 166/297 |
| 6,029,756 | A * | 2/2000 | Britzke et al. | 175/57 |
| 6,116,343 | A | 9/2000 | Van Petegem et al. | 166/297 |
| 6,230,805 | B1 | 5/2001 | Vercaemer et al. | 166/300 |
| 6,257,338 | B1 | 7/2001 | Kilgore et al. | 166/387 |

(Continued)

OTHER PUBLICATIONS

"SurgiFrac[SM] Service Fracture Stimulation Technique for Horizontal Completions in Low-to-Medium-Permeability Reservoirs." Halliburton Communications, Feb. 2003.

(Continued)

*Primary Examiner*—Jennifer H. Gay
*Assistant Examiner*—Daniel P Stephenson
(74) *Attorney, Agent, or Firm*—John W. Wustenberg; Baker Botts, L.L.P.

(57) ABSTRACT

Methods and apparatus for fracturing a subterranean formation which use a fracturing tool. The fracturing tool includes a hydrajet tool, with at least one fluid jet and at least one fracturing port extending through the liner. The fracturing tool further includes a rotating sleeve with at least one interior fracturing port and at least one interior fluid jet port. Finally, the fracturing tool may include a power unit capable of changing the orientation of the rotating sleeve. During fracturing operations, fracturing fluid is pressured through the fluid jet to form microfractures. The orientation of the rotating sleeve may then be changed and fluid may be forced through the fracturing ports to form fractures by the stagnation pressure of the fracturing fluid.

25 Claims, 2 Drawing Sheets

U.S. PATENT DOCUMENTS

| | | | | |
|---|---|---|---|---|
| 6,286,598 | B1 | 9/2001 | van Petegem et al. | 166/297 |
| 6,286,600 | B1 | 9/2001 | Hall et al. | 166/305.1 |
| 6,306,800 | B1 | 10/2001 | Samuel et al. | 507/129 |
| 6,394,184 | B1 | 5/2002 | Tolman et al. | 166/281 |
| 6,494,260 | B1 | 12/2002 | van Petegem et al. | 166/278 |
| 6,497,284 | B1 | 12/2002 | van Petegem et al. | 166/297 |
| 6,508,307 | B1 | 1/2003 | Almaguer | 166/308 |
| 6,520,255 | B1 | 2/2003 | Tolman et al. | 166/281 |
| 6,543,538 | B1 | 4/2003 | Tolman et al. | 166/284 |
| 6,547,011 | B1 | 4/2003 | Kilgore | 166/387 |
| 6,554,075 | B1 | 4/2003 | Fikes et al. | 166/379 |
| 6,601,646 | B1 | 8/2003 | Streich et al. | 166/278 |
| 6,604,581 | B1 | 8/2003 | Moake et al. | 166/250.07 |
| 6,644,110 | B1 | 11/2003 | Curtis et al. | 73/152.51 |
| 6,662,874 | B1 * | 12/2003 | Surjaatmadja et al. | 166/309 |
| 6,668,948 | B1 * | 12/2003 | Buckman et al. | 175/67 |
| 6,938,690 | B1 * | 9/2005 | Surjaatmadja | 166/242.2 |
| 2003/0051876 | A1 * | 3/2003 | Tolman et al. | 166/313 |
| 2003/0062167 | A1 * | 4/2003 | Surjaatmadja et al. | 166/308 |
| 2005/0061508 | A1 * | 3/2005 | Surjaatmadja | 166/306 |
| 2005/0121196 | A1 * | 6/2005 | East et al. | 166/308.1 |
| 2005/0133226 | A1 * | 6/2005 | Lehman | 166/312 |

OTHER PUBLICATIONS

"CobraJet Frac$^{SM}$ Service Cost-effective Technology That Can Help Reduce Cost Per BOE Produced, Shorten Cycle Time and Reduce Capex," Halliburton Communications, undated.

"CobraFrac$^{SM}$ Service Coiled Tubing Fracturing—Cost-Effective Method for Stimulating Untapped Reserves," Halliburton Energy Services, Inc., Dec. 2000.

L. W. Knowlton, Empire Exploration Inc., "Depth Control for Openhole Frac Procedure," SPE Paper 21294, 1990.

Michael L. Connell, et al., "High-Pressure/High-Temperature Coiled Tubing Casing Collar Locator Provides Accurate Depth Control for Single-Trip Perforating," SPE Paper 60698, 2000.

Michael L. Connell, et al., "Development of a Wireless Coiled Tubing Collar Locator," SPE Paper 54327, 1999.

G. Rodvelt, et al., "Multiseam Coal Stimulation Using Coiled-Tubing Fracturing and a Unique Bottomhole Packer Assembly," SPE Paper 72380, 2001.

M. J. Granger, et al., "Horizontal Well Applications in the Guymon-Hugoton Field: A Case Study," SPE Paper 35641, 1995.

J. K. Flowers, et al., "Solutions to Coiled Tubing Depth Control," SPE Paper 74833, 2002.

* cited by examiner

HYDRAJET PERFORATION AND FRACTURING TOOL

BACKGROUND

The present invention relates generally to an improved method and system for fracturing a subterranean formation to stimulate the production of desired fluids therefrom.

Hydraulic fracturing is often utilized to stimulate the production of hydrocarbons from subterranean formations penetrated by wellbores. Typically, in performing hydraulic fracturing treatments, the well casing, where present, such as in vertical sections of wells adjacent the formation to be treated, is perforated. Where only one portion of a formation is to be fractured as a separate stage, it is then isolated from the other perforated portions of the formation using conventional packers or the like, and a fracturing fluid is pumped into the wellbore through the perforations in the well casing and into the isolated portion of the formation to be stimulated at a rate and pressure such that fractures are formed and extended in the formation. A propping agent may be suspended in the fracturing fluid which is deposited in the fractures. The propping agent functions to prevent the fractures from closing, thereby providing conductive channels in the formation through which produced fluids can readily flow to the wellbore. In certain formations, this process is repeated in order to thoroughly populate multiple formation zones or the entire formation with fractures.

One method for fracturing formations may be found in U.S. Pat. No. 5,765,642, incorporated herein by reference in its entirety, whereby a hydrajetting tool is utilized to jet fluid through a nozzle against a subterranean formation at a pressure sufficient to form a cavity and fracture the formation using stagnation pressure in the cavity. In certain situations when using a hydrajetting tool, such as that described in U.S. Pat. No. 5,765,642, it may be desirable to deliver fracturing fluid into the wellbore rapidly. Further, it may be undesirable to pump certain fluids, such as fluids containing proppant, through the hydrajets. In such situations, it would be desirable to have a method and tool for delivering fluids to the formation to be fractured without delivering these fluids through the hydrajet itself.

SUMMARY

The present invention is directed to an apparatus and method for fracturing and/or perforating a formation.

More specifically, one embodiment of the present invention is directed to a fracturing tool. The fracturing tool includes a hydrajet tool with at least one fracturing port and at least one fluid jet. The fracturing tool further includes a rotating sleeve located coaxially within the hydrajet tool. The rotating sleeve includes a sleeve axis, at least one interior fracturing port and at least one interior fluid jet port. The fracturing tool also includes a power unit that is connected to the rotating sleeve and is capable of rotating the rotating sleeve about the sleeve axis.

Another embodiment of the present invention is directed to a method for fracturing a subterranean formation penetrated by a wellbore by positioning a fracturing tool adjacent the subterranean formation. The fracturing tool includes a hydrajet tool having at least one fracturing port and at least one fluid jet, a rotating sleeve located coaxially within the hydrajet tool and having a sleeve axis, at least one interior fracturing port and at least one interior fluid jet port and a power unit connected to the rotating sleeve and capable of rotating the rotating sleeve about the sleeve axis. Next, the rotating sleeve is oriented so that at least one fluid jet and at least one interior fluid jet port are aligned. Fluid is jetted through the at least one fluid jet against the subterranean formation at a pressure sufficient to form a cavity in the formation. The rotating sleeve is oriented so that at least one fracturing port and at least one interior fracturing port are aligned. Fluid is pumped into the wellbore to cause sufficient stagnation pressure to fracture the subterranean formation.

The features and advantages of the present invention will be readily apparent to those skilled in the art upon a reading of the description of the exemplary embodiments, which follows.

BRIEF DESCRIPTION OF THE DRAWINGS

A more complete understanding of the present disclosure and advantages thereof may be acquired by referring to the following description taken in conjunction with the accompanying drawings.

DETAILED DESCRIPTION

In wells penetrating certain formations, and particularly deviated wells, it is often desirable to create relatively small fractures referred to in the art as "microfractures" in the formations near the wellbores to facilitate creation of hydraulically induced enlarged fractures. In accordance with the present invention, such microfractures are formed in subterranean well formations utilizing a fracturing tool.

The fracturing tool is positioned within a formation to be fractured and fluid is then jetted through the fluid jet against the formation at a pressure sufficient to form a cavity therein and fracture the formation by stagnation pressure in the cavity. A high stagnation pressure is produced at the tip of a cavity in a formation being fractured because of the jetted fluids being trapped in the cavity as a result of having to flow out of the cavity in a direction generally opposite to the direction of the incoming jetted fluid. The high pressure exerted on the formation at the tip of the cavity causes a microfracture to be formed and extended a short distance into the formation.

In order to extend a microfracture formed as described above further into the formation in accordance with this invention, a fluid is pumped through the fracturing port into the wellbore to raise the ambient fluid pressure exerted on the formation after the formation is fractured by the fluid jet. The fluid in the wellbore flows into the cavity produced by the fluid jet and flows into the fracture at a rate and high pressure sufficient to extend the fracture an additional distance from the wellbore into the formation.

Figure 2:
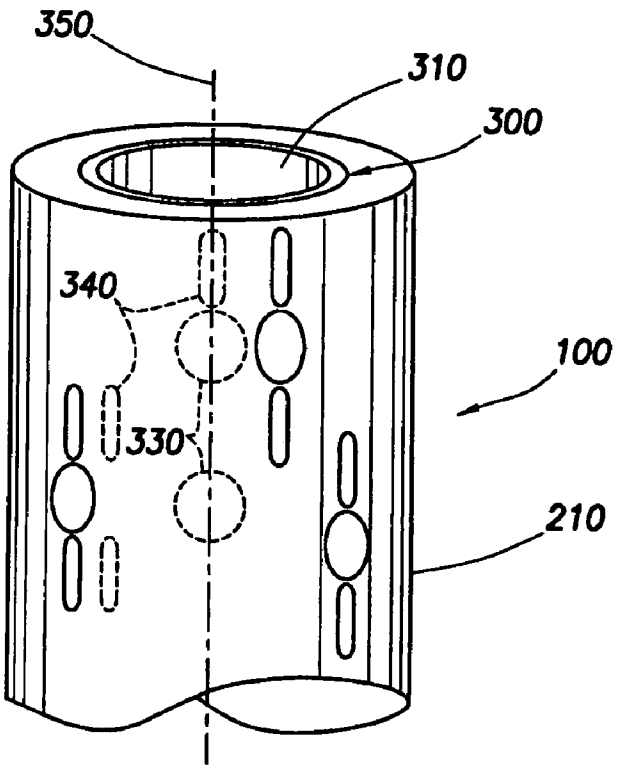
FIG. 2 is a cutaway view of an embodiment of a fracturing tool according to the present invention depicting the rotating sleeve and associated ports.
Figure 1:
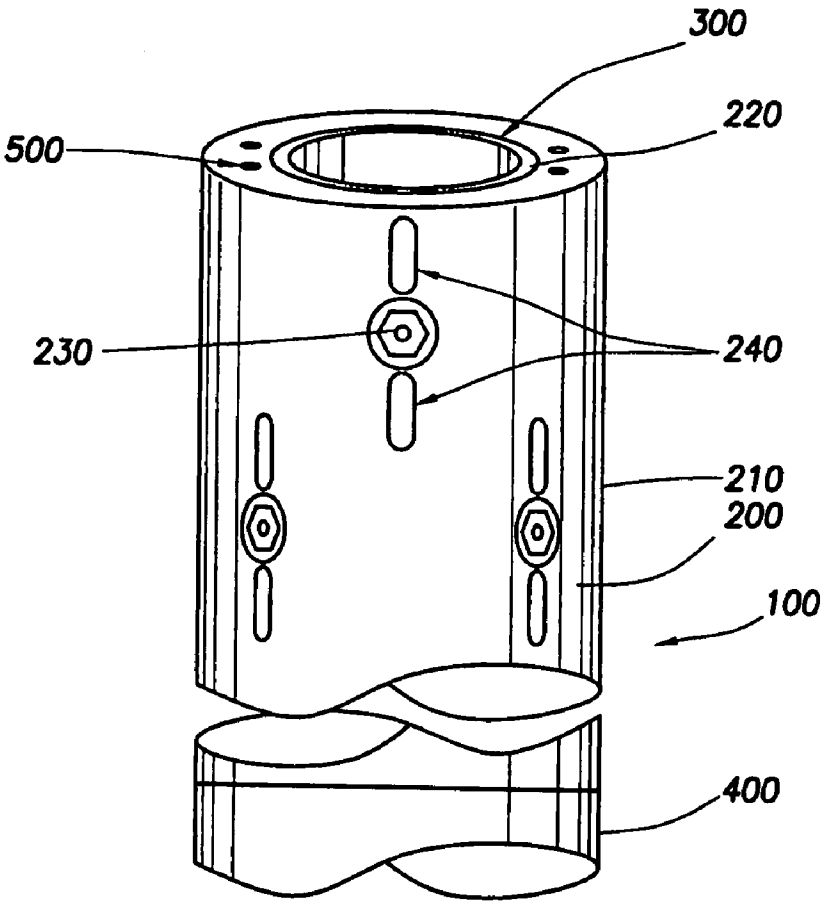
FIG. 1 is an elevational view of one embodiment of a fracturing tool according to the present invention.

The details of the present invention will now be described with reference to the accompanying drawings. Turning to FIG. 1, a fracturing tool in accordance with the present invention is shown generally by reference numeral 100. Fracturing tool 100 includes a hydrajet tool 200, which is generally cylindrical in shape and has a hydrajet outer wall 210 and hydrajet inner wall 220. Extending longitudinally within hydrajet tool 200 is rotating sleeve 300, as shown in FIG. 2. Rotating sleeve 300 is designed to be capable of rotating longitudinally within hydrajet tool 200. Axial fluid passageway 310 extends through rotating sleeve 300.

Figure 3:
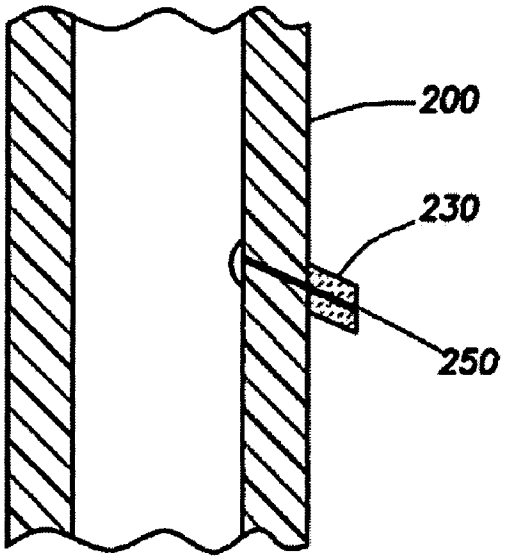
FIG. 3 is an expanded side view of one embodiment of a fracturing tool according to the present invention.

Extending radially through hydrajet inner wall 220 and hydrajet outer wall 210 is at least one fluid jet 230. Fluid jet 230 may extend beyond hydrajet outer wall 210, as depicted in FIG. 3, or fluid jet 230 may extend only to the surface of hydrajet outer wall 210. In embodiments where fluid jet 230 extends beyond hydrajet outer wall 210, its orientation may be dependent upon the formation to be fractured. As further depicted in FIG. 3, fluid jet 230 has an exterior opening, fluid jet nozzle 250, that allows fluid to pass from hydrajet tool 200 through fluid jet 230. In an exemplary embodiment where fluid jet 230 extends beyond hydrajet outer wall 210, fluid jet 230 is an approximately cylindrical, hollow projection oriented at an angle between about 30° and about 90° from hydrajet outer wall 210, more preferably between about 45° and about 90°. Fluid jet 230 may be composed of any material that is capable of withstanding the stresses associated with fluid fracture and the abrasive nature of the fracturing or other treatment fluid and any proppants or other fracturing agents used. Non-limiting examples of appropriate materials of construction of fluid jet 230 are tungsten carbide and certain ceramics.

Fluid jet 230 orientation relative of hydrajet outer wall 210 may coincide with the orientation of the plane of minimum principal stress, or the plane perpendicular to the minimum stress direction in the formation to be fractured relative to the axial orientation of the wellbore penetrating the formation. Fluid jet circumferential location about liner hydrajet tool 200 may be chosen depending on the particular well, field, or formation to be fractured. For instance, in certain circumstances, where multiple fluid jets 230 are employed, it may be desirable to orient all fluid jets 230 towards the surface for certain formations or 90° stations about the circumference of hydrajet tool 200 for other formations. It is further possible to alter the internal diameter of fluid jets 230 dependent upon the locations of particular fluid jets 230 along the wellbore, the formation, well, or field. One of ordinary skill in the art may vary these parameters to achieve the most effective treatment for the particular well.

Also extending through hydrajet inner wall 220 and hydrajet outer wall 210 are one or more fracturing ports 240. Fracturing ports 240 are designed to allow fluids to pass through hydrajet tool 200 when it is not desirable to pass the particular fluid through fluid jet 230. In typical embodiments, fluid jet nozzle 250 has a diameter sized so as to increase the pressure of the fluid being jetted through fluid jet 230 to a suitable pressure to cause microfractures in the subterranean formation. The increased pressure allowed by reducing the diameter fluid jet nozzle 250 increases the pressure drop of fluid travelling through fluid jet 230, thereby decreasing the actual flow rate through fluid jet 230. When extending the microfractures into the formation, as described above, it may be desirable to introduce the fracturing fluid at a rate more than would be practical through fluid jet 230. It also may be undesirable to introduce certain fluids into wellbores through fluid jet 230, such as fluids containing proppants in existing wells. The increased pressure of the fluid containing proppants leaving fluid jet 230 may damage equipment in the well, such as gas lift mandrels. Fracturing ports 240 are designed to allow fluid through hydrajet tool 200 without necessarily also passing through fluid jets 230.

As shown in FIG. 2, interior fluid jet port 330 is an aperture on rotating sleeve 300 designed to allow fluid to pass from axial fluid passageway 310 to fluid jet 230 when properly aligned as described below. Interior fracturing ports 340 are one or more apertures designed to allow fluid to pass from axial fluid passageway 310 to one or more fracturing ports 240.

Rotating sleeve 300 is designed to be rotated about sleeve axis 350. By changing the orientation of rotating sleeve 300 about sleeve axis 350, interior fracturing ports 340 may be aligned or misaligned from fracturing ports 240. Similarly, interior fluid jet port 330 may be aligned or misaligned from fluid jet 230. Hence, it is possible by controlling the orientation of rotating sleeve 300 about sleeve axis 350 to control whether fluid from axial fluid passageway 310 flows through fluid jet(s) 230, fracturing port(s) 240, or a combination of fluid jet(s) 230 and fracturing port(s) 240. In one embodiment of the present invention, it is possible to orient rotating sleeve 300 so as to prevent flow from either fluid jet 230 or fracturing port 240.

As discussed above, fluid jet(s) 230 are designed to restrict fluid flow and increase the pressure of the fluid by using a restricted diameter. In at least one embodiment of the present invention, it is possible to allow more fluid flow through aligned fracturing port(s) 240 and interior fracturing port(s) 340 than through aligned fluid jet(s) 230 and interior fluid jet port(s) 340. This may be accomplished by a number of methods. For instance, the combined aperture area of all fluid jets 230 may be less than that of the combined aperture area of all fracturing ports 240. In some embodiments of the present invention, the combined aperture area of all fracturing port(s) 240 is between about 10 and about 100 times as great as the combined aperture area of fluid jet(s) 230. In other embodiments, the combined aperture area of all fracturing port(s) 240 is between about 20 and about 50 times as great as the combined aperture area of fluid jet(s) 230. In other embodiments of the present invention, it is possible to orient rotating sleeve 300 so that the combined aperture area of all fluid jet(s) 230 and interior fluid jet port(s) 330 that are aligned, i.e., aligned fluid jets is less than the combined aperture area of all fracturing port(s) 240 and interior fracturing port(s) 340 that are aligned, i.e., aligned fracturing ports. In some embodiments of the present invention, the combined aperture area of all aligned fracturing port(s) 240 and interior fracturing port(s) 340 is between about 10 and about 100 times as great as the combined aperture area of all aligned fluid jet(s) 230 and interior fluid jet port(s) 330. In other embodiments, the combined aperture area of all fracturing port(s) 240 is between about 20 and about 50 times as great as the combined aperture area of all aligned fluid jet(s) 230 and interior fluid jet port(s) 330.

Rotating sleeve 300 may be rotated about sleeve axis 350 through any number of methods known in the art. One non-limiting example of a device for re-orienting rotating sleeve 300 about sleeve axis 350, as depicted in FIG. 1, is by connecting rotating sleeve 300 to downhole power unit 400. Downhole power unit 400 may be any suitable downhole power unit, most often battery powered. Downhole power unit 400 may be located above rotating sleeve 300 or below rotating sleeve 300, as shown in FIG. 1. Where downhole power unit 400 is located above rotating sleeve 300, it must be designed so as to allow fluid flow to rotating axial fluid passageway 310. Further, when downhole power unit 400 is located above rotating sleeve 300, rotating sleeve fracturing tool 100 may be open-ended and would typically be plugged, such as a standard plug or a check valve such that no treatment fluids, for instance the fracturing fluid, may exit through the open end of rotating sleeve fracturing tool 100. In another embodiment of the present invention, the rotating sleeve is rotated about sleeve axis 350 from the surface.

Where downhole power unit 400 is used as the means to orient rotating sleeve 300, it may be necessary to communicate between surface equipment and downhole power unit 400 in order to change orientation. Non-limiting examples of such communications means include mud pulse, sonic, or wireline. Wireline communication is depicted in FIG. 1. Conducting material 500 is installed between hydrajet outer wall 210 and hydrajet inner wall 220. Typically, when utilizing conducting material 500, hydrajet tool 200 should be composed of a composite material with limited ability to conduct electricity to avoid electrical shorts. Conducting material 500 connects surface equipment with downhole power unit 400 to allow communication between surface equipment and downhole power unit 400 to change the orientation of rotating sleeve 300.

In order to fracture a subterranean formation, fracturing tool 100 is lowered into a wellbore until the desired formation to be fractured is reached. Typically, well casing must first be perforated prior to fracturing the formation. Such perforation may be accomplished by traditional methods, such as through the use of explosives. Perforation may also be accomplished through the use of rotating sleeve fracturing tool 100. Rotating sleeve 300 is rotated so as to align at least one fluid jet 230 with a corresponding interior fluid jet port 330. A perforation fluid may then be jetted through fluid jets 230 so as to perforate the well casing.

Figure 4:
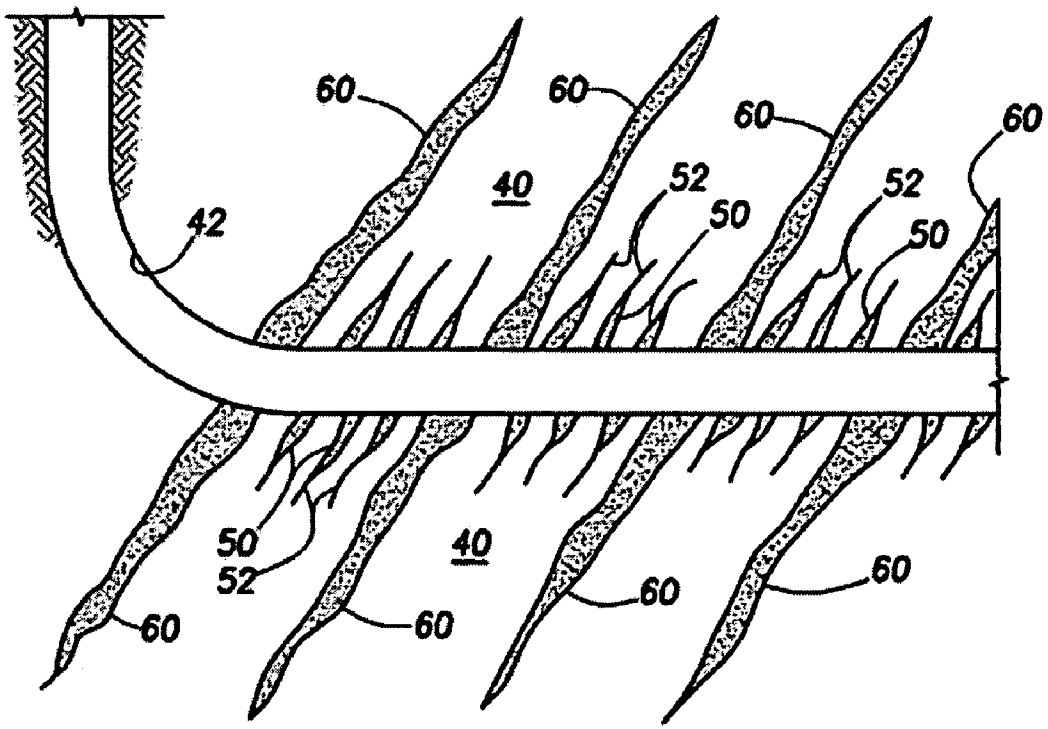
FIG. 4 is a schematic diagram of a subterranean formation fractured using the fracturing tool according to the present invention.

Following perforation, the formation may be fractured. The pump rate of the fluid into axial fluid passageway 310 and through fluid jets 230 is increased to a level whereby the pressure of the fluid which is jetted through fluid jets 230 reaches the jetting pressure sufficient to cause the creation of the cavities 50 and microfractures 52 in the subterranean formation 40 as illustrated in FIG. 4.

A variety of fluids can be utilized in accordance with the present invention for forming fractures, including aqueous fluids, viscosified fluids, oil based fluids, and even certain "non-damaging" drilling fluids known in the art. Various additives can also be included in the fluids utilized such as abrasives, fracture propping agent, e.g., sand or artificial proppants, acid to dissolve formation materials, and other additives known to those skilled in the art.

As will be described further hereinbelow, the jet differential pressure(Pjd) at which the fluid must be jetted from fluid jet 230 to result in the formation of the cavities 50 and microfractures 52 in the subterranean formation 40 is a pressure of approximately two times the pressure required to initiate a fracture in the formation less the ambient pressure (Pa) in the wellbore adjacent to the formation i.e., $Pjd \geqq 2\times(Pi-Pa)$. The pressure required to initiate a fracture in a particular formation is dependent upon the particular type of rock and/or other materials forming the formation and other factors known to those skilled in the art. Generally, after a wellbore is drilled into a formation, the fracture initiation pressure can be determined based on information gained during drilling and other known information. Since wellbores are often filled with drilling fluid and since many drilling fluids are undesired, the fluid could be circulated out, and replaced with desirable fluids that are compatible with the formation. The ambient pressure in the wellbore adjacent to the formation being fractured is the hydrostatic pressure exerted on the formation by the fluid in the wellbore.

When fluid is pumped into the wellbore to increase the pressure to a level above hydrostatic to extend the microfractures as will be described further hereinbelow, the ambient pressure is whatever pressure is exerted in the wellbore on the walls of the formation to be fractured as a result of the pumping.

At a stand-off clearance of about 1.5 inches between the face of fluid jets 230 and the walls of the wellbore and when the jets formed flare outwardly from their cores at an angle of about 20°, the jet differential pressure required to form the cavities 50 and the microfractures 52 is a pressure of about 2 times the pressure required to initiate a fracture in the formation less the ambient pressure in the wellbore adjacent to the formation. When the stand off clearance and degree of flare of the fluid jets are different from those given above, the following formulas can be utilized to calculate the jetting pressure.

$$Pi=Pf-Ph$$

$$\Delta P/Pi=1.1[d+(s+0.5)\tan(\text{flare})]^2/d.^2$$

wherein;

Pi=difference between formation fracture pressure and ambient pressure, psi

Pf=formation fracture pressure, psi

Ph=arnbient pressure, psi

ΔP=the jet differential pressure, psi d=diameter of the jet, inches s=stand off clearance, inches flare=flaring angle of jet, degrees As mentioned above, propping agent may be combined with the fluid being jetted so that it is carried into the cavities 50 into fractures 60 connected to the cavities. The propping agent functions to prop open the fractures 60 when they attempt to close as a result of the termination of the fracturing process. In order to insure that the propping agent remains in the fractures when they close, the jetting pressure is preferably slowly reduced to allow fractures 60 to close on propping agent which is held in fractures 60 by the fluid jetting during the closure process. In addition to propping the fractures open, the presence of the propping agent, e.g., sand, in the fluid being jetted facilitates the cutting and erosion of the formation by the fluid jets. As indicated, additional abrasive material can be included in the fluid, as can one or more acids which react with and dissolve formation materials to enlarge the cavities and fractures as they are formed. Alternatively, rather than include the proppant in the fluid jetted through fluid jet 230, it may be desirable to introduce the proppant-carrying fluid through fracturing ports 240. When introducing the proppant-carrying fluid to the formation through fracturing ports 240, rotating sleeve 300 is first re-oriented to align at least one interior fracturing port 340 with at least one fracturing port 240. Proppant-carrying fluid may then be pumped through axial fluid passageway 310 through fracturing port 240 and into the formation.

As further mentioned above, some or all of the microfractures produced in a subterranean formation can be extended into the formation by pumping a fluid into the wellbore to raise the ambient pressure therein. Following the hydrajetting of the formation, rotating sleeve 300 is re-oriented to align at least one interior fracturing port 340 with at least one fracturing port 240. Fracturing fluid may then be pumped through axial fluid passageway 310 through fracturing port 240 and into the formation at a rate to raise the ambient pressure in the wellbore adjacent the formation to a level such that the cavities 50 and microfractures 52 are enlarged and extended whereby enlarged and extended fractures 60 are formed. As shown in FIG. 4, the enlarged and extended fractures 60 are preferably formed in spaced relationship along wellbore 42 with groups of the cavities 50 and microfractures 52 formed therebetween.

Following the fracture of the subterranean formation, the wellbore may be "packed," i.e., a packing material may be introduced into the fractured zone to reduce the amount of fine particulants such as sand from being produced during the production of hydrocarbons. The process of "packing" is well known in the art and typically involves packing the well adjacent the unconsolidated or loosely consolidated production interval, called gravel packing. In a typical gravel pack completion, a sand control screen is lowered into the wellbore on a workstring to a position proximate the desired production interval. A fluid slurry including a liquid carrier and a relatively coarse particulate material, which is typically sized and graded and which is referred to herein as gravel, is then pumped down the workstring and into the well annulus formed between the sand control screen and the perforated well casing or open hole production zone.

The liquid carrier either flows into the formation or returns to the surface by flowing through a wash pipe or both. In either case, the gravel is deposited around the sand control screen to form the gravel pack, which is highly permeable to the flow of hydrocarbon fluids but blocks the flow of the fine particulate materials carried in the hydrocarbon fluids. As such, gravel packs can successfully prevent the problems associated with the production of these particulate materials from the formation.

In another embodiment of the present invention, the proppant material, such as sand, is consolidated to better hold it within the microfractures. Consolidation may be accomplished by any number of conventional means, including, but not limited to, introducing a resin coated proppant (RCP) into the microfractures.

Therefore, the present invention is well-adapted to carry out the objects and attain the ends and advantages mentioned as well as those which are inherent therein. While the invention has been depicted, described, and is defined by reference to exemplary embodiments of the invention, such a reference does not imply a limitation on the invention, and no such limitation is to be inferred. The invention is capable of considerable modification, alteration, and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects.

What is claimed is:

1. A fracturing tool comprising:

a hydrajet tool, wherein the hydrajet tool comprises:

a fracturing port, wherein the fracturing port has a fracturing port aperture area;

a fluid jet capable of creating a jet differential pressure required to form cavities and microfractures in a subterranean formation, wherein the fluid jet has a fluid aperture jet area;

a hydrajet inner wall; and a hydrajet outer wall;

a rotating sleeve, wherein the rotating sleeve is located coaxially within the hydrajet tool, and the rotating sleeve comprises:

a sleeve axis;

an interior fracturing port; and an interior fluid jet port; and a power unit, wherein the power unit is connected to the rotating sleeve and capable of rotating the rotating sleeve about the sleeve axis, and wherein the power unit comprises a downhole power unit.

2. The fracturing tool according to claim 1 further comprising a communications means, wherein the communications means is capable of communicating between the downhole power unit and surface equipment.

3. The fracturing tool according to claim 2 wherein the communications means transmits mud pulse signals, sonic signals, or wireline signals.

4. The fracturing tool according to claim 3 wherein:

the communication means comprises the wireline signal; and the hydrajet tool comprises:

a composite material; and a conducting material located between the hydrajet inner wall and the hydrajet outer wall.

5. The fracturing tool of claim 1 wherein the fluid jet comprises tungsten carbide or ceramic.

6. The fracturing tool of claim 1 wherein the fracturing port aperture area is greater than the fluid jet aperture area.

7. The fracturing tool of claim 6 wherein the fracturing port aperture area is between about 10 and about 100 times greater than the fluid jet aperture area.

8. The fracturing tool of claim 7 wherein the fracturing port aperture area is between about 20 and about 50 times greater than the fluid port aperture area.

9. A fracturing tool comprising:

a hydrajet tool, wherein the hydrajet tool comprises:

a fracturing port, wherein the fracturing port has a fracturing port aperture area;

a fluid jet capable of creating a jet differential pressure reciuired to form cavities and microfractures in a subterranean formation, wherein the fluid jet has a fluid aperture jet area, and wherein the fluid jet extends beyond the hydrajet outer wall and is oriented at an angle between about 30 degrees and about 90 degrees relative to the hydrajet outer wall;

a hydrajet inner walk; and a hydrajet outer walk;

a rotating sleeve, wherein the rotating sleeve is located coaxially within the hydrajet tool, and the rotating sleeve comprises:

a sleeve axis;

an interior fracturing port; and an interior fluid jet port; and a power unit, wherein the power unit is connected to the rotating sleeve and capable of rotating the rotating sleeve about the sleeve axis.

10. The fracturing tool of claim 9 wherein the fluid jet is oriented at an angle between about 45 degrees and about 90 degrees relative to the hydrajet outer wall.

11. A fracturing tool comprising:

a hydrajet tool, wherein the hydrajet tool comprises:

a fracturing port, wherein the fracturing port has a fracturing port aperture area;

a fluid jet capable of creating a jet differential pressure required to form cavities and microfractures in a subterranean formation, wherein the fluid jet has a fluid aperture jet area;

a plurality of fracturing ports, wherein the fracturing ports have a combined fracturing port aperture area equal to the sum of the fracturing port aperture areas for each fracturing port;

a plurality of fluid jets, wherein the fluid jets have a combined fluid jet aperture area equal to the sum of the fluid jet aperture areas for each fluid jet;

a hydrajet inner wall; and a hydrajet outer wall;

a rotating sleeve, wherein the rotating sleeve is located coaxially within the hydrajet tool, and the rotating sleeve comprises:

a sleeve axis;

an interior fracturing port; and an interior fluid jet port; and a power unit, wherein the power unit is connected to the rotating sleeve and capable of rotating the rotating sleeve about the sleeve axis.

12. The fracturing tool of claim 11 wherein the combined fracturing port aperture area is greater than the combined fluid jet aperture area.

13. The fracturing tool of claim 12 wherein the combined fracturing port aperture area is between about 10 and about 100 times greater than the combined fluid jet aperture area.

14. The fracturing tool of claim 13 wherein the combined fracturing port aperture area is between about 20 and about 50 times greater than the combined fluid port aperture area.

15. A method for fracturing a subterranean formation penetrated by a wellbore, comprising the steps of:

(a) positioning a fracturing tool adjacent the subterranean formation, wherein the fracturing tool comprises:

a hydrajet tool comprising:

at least one fracturing port; and at least one fluid jet;

a rotating sleeve located coaxially within the hydrajet tool and having a sleeve axis, wherein the rotating sleeve comprises:

at least one interior fracturing port; and at least one interior fluid jet port; and a power unit connected to the rotating sleeve and capable of rotating the rotating sleeve about the sleeve axis;

(b) orienting the fracturing tool so that at least one fluid jet and at least one interior fluid jet port are aligned forming an aligned fluid jet having an aligned fluid jet aperture area;

(c) jetting fluid through the at least one fluid jet against the subterranean formation at a pressure sufficient to form a cavity in the formation;

(d) orienting the fracturing tool so that at least one fracturing port and at least one interior fracturing port are aligned forming an aligned fracturing port having an aligned fracturing port aperture area; and (e) pumping fluid into the wellbore to cause sufficient stagnation pressure to fracture the subterranean formation.

16. The method of claim 15 further comprising prior to step (c), the step of jetting fluid through the at least one fluid jet against a well casing in the wellbore to perforate the well casing.

17. The method of claim 15 further comprising following step (e), the step (f) of pumping a proppant-containing fluid into the wellbore.

18. The method of claim 17 further comprising following step (f) the step of introducing a consolidation material into microfractures through the fracturing port.

19. The method of claim 15 wherein the aligned fracturing port aperture area is greater than the aligned fluid jet aperture area.

20. The method of claim 19 wherein the aligned fracturing port aperture area is between about 10 and about 100 times greater than the aligned fluid jet aperture area.

21. The method of claim 20 wherein the aligned fracturing port aperture area is between about 20 and about 50 times greater than the aligned fluid jet aperture area.

22. The method of claim 15 wherein the fracturing tool further comprises a plurality of aligned fluid jets and aligned fracturing ports, wherein:

the aligned fluid jets have a combined aligned fluid jet aperture area equal to the sum of the aligned fluid jet aperture areas for each of the aligned fluid jets; and the aligned fracturing ports have a combined aligned fracturing port aperture area equal to the sum of each of the aligned fracturing port aperture areas for each aligned fracturing ports.

23. The method of claim 22 wherein the combined aligned fracturing port aperture area is greater than the combined aligned fluid jet aperture area.

24. The method of claim 23 wherein the combined aligned fracturing port aperture area is between about 10 and about 100 times greater than the combined aligned fluid jet aperture area.

25. The method of claim 24 wherein the combined aligned fracturing port aperture area is between about 20 and about 50 times greater than the combined aligned fluid jet aperture area.

* * * * *